US012172854B2

(12) United States Patent
Hwan et al.

(10) Patent No.: US 12,172,854 B2
(45) **Date of Patent: *Dec. 24, 2024**

(54) DISPENSER OF STRETCH WRAP

(71) Applicant: TG PLASTIC TECHNOLOGIES SDN. BHD., Sungai Petani (MY)

(72) Inventors: Ang See Hwan, Sungai Petani (MY); Lau Tee Yeow, Sungai Petani (MY)

(73) Assignee: TG PLASTIC TECHNOLOGIES SDN. BHD., Kedah (MY)

( * ) Notice: Subject to any disclaimer, the term of this patent is extended or adjusted under 35 U.S.C. 154(b) by 0 days.

This patent is subject to a terminal disclaimer.

(21) Appl. No.: 18/382,678

(22) Filed: Oct. 23, 2023

(65) Prior Publication Data

US 2024/0051776 A1 Feb. 15, 2024

Related U.S. Application Data

(62) Division of application No. 17/709,686, filed on Mar. 31, 2022, now Pat. No. 11,827,473.

(30) Foreign Application Priority Data

Apr. 12, 2021 (MY) ..... PI2021001981

(51) Int. Cl.

| | |
|---|---|
| ***B65H 16/06*** | (2006.01) |
| ***B65B 67/08*** | (2006.01) |
| ***B65H 19/12*** | (2006.01) |
| ***B65H 23/06*** | (2006.01) |

(52) U.S. Cl.

CPC ..... *B65H 16/06* (2013.01); *B65B 67/085* (2013.01); *B65H 19/12* (2013.01); *B65H 23/063* (2013.01); *B65H 2301/4134* (2013.01); *B65H 2402/412* (2013.01)

(58) Field of Classification Search

None

See application file for complete search history.

(56) References Cited

U.S. PATENT DOCUMENTS 11,827,473 B2 * 11/2023 Hwan ..... B65H 19/12

* cited by examiner

*Primary Examiner* — William A. Rivera

(74) *Attorney, Agent, or Firm* — Blake E. Vande Garde; Avek IP, LLC

(57) ABSTRACT

The present invention provides a dispenser of stretch wrap, comprising a main body with a first end, a second end, a first connector portion proximate to the first end, a second connector portion proximate to the second end, a first braking mechanism at the first connector portion, a second braking mechanism at the second connector portion, a tension controller terminating an end of the second connector portion, the first connector portion and second connector portion are adapted to engage two ends of an elongated core with stretch wrap film, the tension controller comprising an adjustable portion that is rotatable and in mechanical communication with a movable part located intermediate the tension controller and the second connector portion and the adjustable portion is a rotatable knob, and the movable part is a clutching mechanism connected to a shaft; characterized in that the tension controller further comprises a tension limiting mechanism.

16 Claims, 8 Drawing Sheets

DISPENSER OF STRETCH WRAP

RELATED CASES

This application claims priority from Malaysian Patent Application No. PI2021001981 filed on Apr. 12, 2021, and is a divisional application of U.S. patent application Ser. No. 17/709,686 filed on Mar. 31, 2022. The disclosure of each application is expressly incorporated herein by reference.

TECHNICAL FIELD

The present disclosure relates to a dispenser. More particularly, the present disclosure relates to a dispenser for a stretch wrap.

BACKGROUND ART

Stretch wrap has been used in the wrapping process of goods, luggage, boxes etc. It may protect from dust, increase the stability of stacked items and properly align arranged items. As the world moves towards green initiative practices, the stretch wrap thickness has been decreased towards the theoretical minimum thickness of 3 micron to 5 micron. However, with that kind of thickness, the stretch wrap is prone to unexpected tears due to over tension of pulling force. Upon testing using the stretch wrap dispenser in the market, this tearing accident occurs more often. The only way to reduce this accident is by using a highly skilled and experienced operator, which is not always available. To eliminate this problem, the stretch wrap dispenser needs to have a limiter of tightening tension.

A U.S. Pat. No. 10,472,115 B2 discloses a system for dispensing film wrap comprising a body, two horizontally aligned interlockable connectors and a knob for controlling one of the connectors to interlocked with the film wrap core tightly. It can prevent the film wrap core from rotatingly slipping from the connectors by applying excessive tightening tension to the film wrap core. However, without the knowledgeable operator, the film wrap with lower thickness will be prone to tear during the wrapping process.

The above problems suggest requirements for further developing a dispenser of stretch wrap to address this problem.

The above information is presented as background information only to assist with an understanding of the present disclosure. No determination has been made, and no assertion is made, as to whether any of the above might be applicable as prior art with regard to the present disclosure.

SUMMARY OF THE INVENTION

Aspects of the present disclosure are to address the above-mentioned problems and or disadvantages and to provide at least the advantages described throughout this patent specification. An aspect of the present disclosure is to provide a dispenser of stretch wrap, comprising a main body having a first end and a second end; a first connector portion configured proximate to the first end of said main body; a second connector portion configured proximate to the second end of said main body; a first braking mechanism located at said first connector portion; a second braking mechanism located at said second connector portion; a tension controller terminating an end of said second connector portion; wherein said first connector portion and said second connector portion being spaced apart from each other along a common axis; said first connector portion and said second connector portion being adapted to engage two ends of an elongated core having stretch wrap film wrapped there around; said tension controller comprising an adjustable portion that is rotatable and in mechanical communication with a movable part located intermediate said tension controller and said second connector portion; and said adjustable portion is a rotatable knob, and said movable part is a clutching mechanism connected to a shaft; characterized in that said tension controller further comprises a tension limiting mechanism.

Another aspect of the present disclosure is to provide a dispenser of stretch wrap, wherein said tension limiting mechanism is a ball plunger.

Another aspect of the present disclosure is to provide a dispenser of stretch wrap, wherein said tension limiting mechanism is a combination of a metal ball and a spring, which is placed inside a tunnel, said tunnel is formed inside said tension controller.

Another aspect of the present disclosure is to provide a dispenser of stretch wrap, wherein said clutching mechanism is a plate having a plurality of concave portion.

Another aspect of the present disclosure is to provide a dispenser of stretch wrap, wherein each of said first braking mechanism and said second braking mechanism is a combination of a carbon steel plate and an oil-filled cast nylon ring pad.

Another aspect of the present disclosure is to provide a dispenser of stretch wrap, wherein each of said first connector portion and said second connector portion is made of aluminium.

Another aspect of the present disclosure is to provide a dispenser of stretch wrap, wherein said dispenser further comprising a gripping mechanism which is protruding through said tension controller and adapted to grip said clutching mechanism.

Another aspect of the present disclosure is to provide a dispenser of stretch wrap, wherein said dispenser further comprising a protective sleeve at the first end of said main body.

Another aspect of the present disclosure is to provide a dispenser of stretch wrap, wherein said main body is a C-shaped body.

Another aspect of the present disclosure is to provide a dispenser of stretch wrap, wherein said main body is a hollow body.

Another aspect of the present disclosure is to provide a dispenser of stretch wrap, wherein said main body further comprising a rubberized portion.

BRIEF DESCRIPTION OF THE DRAWING

The above and other aspects, features, and advantages of certain embodiments of the present disclosure will be more apparent from the following description taken in conjunction with the accompanying drawing, in which.

DETAIL DESCRIPTION OF THE PREFERRED EMBODIMENT

Figure 1:
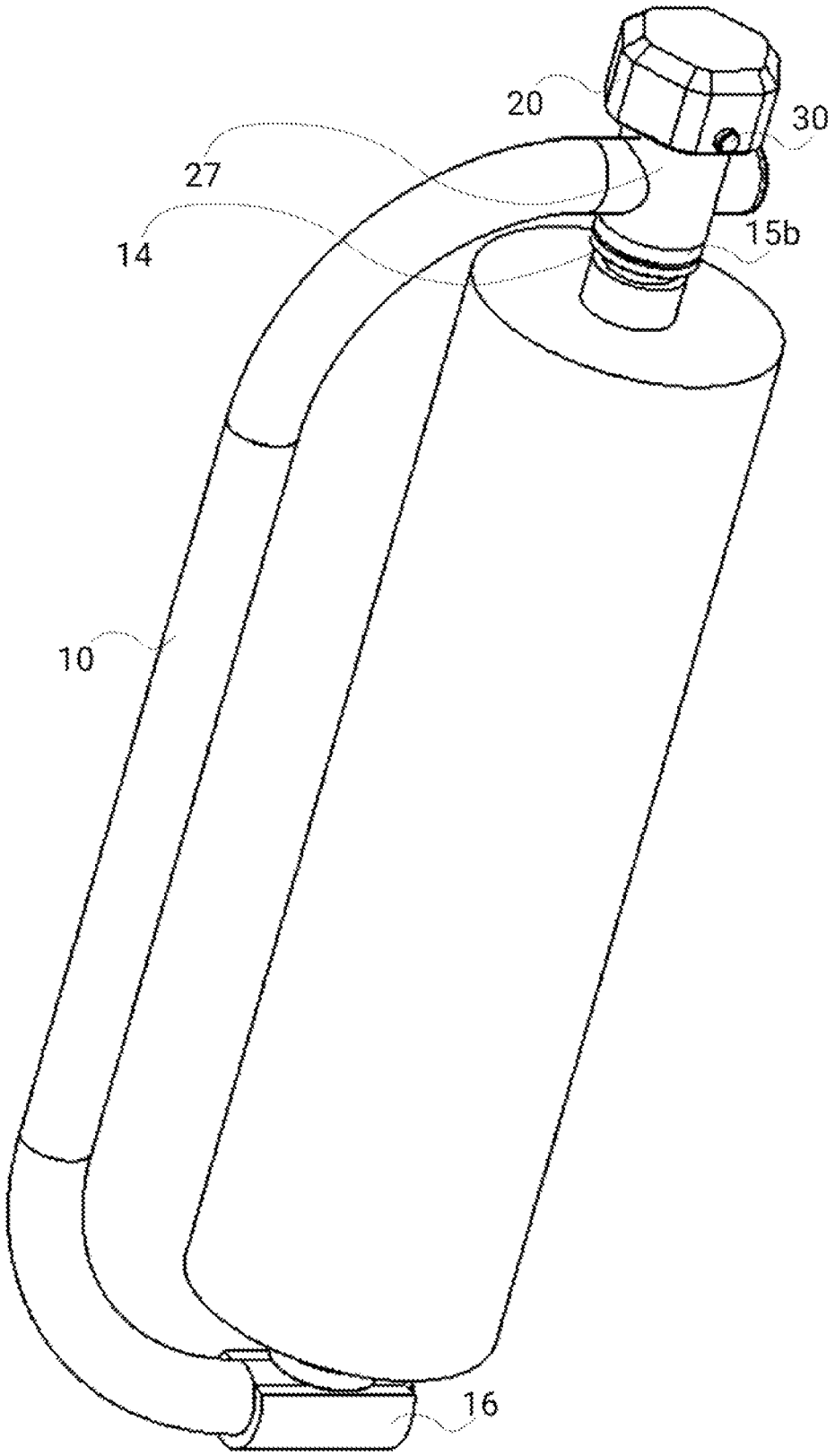
FIG. 1 shows a dispenser for a stretch wrap with the stretch wrap in position according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope of the present disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the present disclosure. Accordingly, it should be apparent to those skilled in the art that the following description of various embodiments of the present disclosure is provided for illustration purposes only and not for the purpose of limiting the present disclosure as defined by the appended claims and their equivalents. Depending on the context of the sentence, the reading of this patent specification should be done with the same concept as "reject the absurd", wherein if possible, a specification should be construed so as not to lead to a foolish result or one which the patentee could not have contemplated.

It is to be understood that the singular forms "a", "an," and "the" include plural referents unless the context clearly dictates otherwise. Thus, for example, reference to "a spring" includes reference to one or more of such springs.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The invention works based on the tested principle that changes in the tightening tension of the core of the stretch wrap will give impact on the pulling tension of the operator. If the tension of the core of the stretch wrap is over the right amount, the operator would need to pull with higher strength, resulting in a continuous tear accident. If the tension of the core of the stretch wrap is less than the right amount, the core tends to slip from the dispenser; or the wrapping process cannot be done correctly because the stretch wrap film is not stretching enough. There is a need to make the dispenser of the stretch wrap works for any operator. Upon rigorous testing, the reports showed that different thickness of the stretch wrap will require different pulling tension to avoid the problems mentioned above.

The present disclosure relates to a dispenser for a stretch wrap. With the decreasing stretch wrap thickness, the stretch wrap prone to accidentally teared during the operation. The present invention provides a dispenser of stretch wrap, comprising a main body 10 having a first end 11 and a second end 12; a first connector portion 13 configured proximate to the first end 11 of said main body 10; a second connector portion 14 configured proximate to the second end 12 of said main body 10; a first braking mechanism 15*a* located at said first connector portion 13; a second braking mechanism 15*b* located at said second connector portion 14; a tension controller terminating an end of said second connector portion 14; wherein said first connector portion 13 and said second connector portion 14 being spaced apart from each other along a common axis; said first connector portion 13 and said second connector portion 14 being adapted to engage two ends of an elongated core having stretch wrap film wrapped there around; said tension controller comprising an adjustable portion that is rotatable and in mechanical communication with a movable part located intermediate said tension controller and said second connector portion 14; and said adjustable portion is a rotatable knob 20, and said movable part is a clutching mechanism 23 connected to a shaft 24; characterized in that said tension controller further comprises a tension limiting mechanism.

In another embodiment, the present invention provides a dispenser of stretch wrap, comprising a main body 10 having a first end 11 and a second end 12; a first magnet 33*a* engaged to and extending from the first end 11; a second magnet 33*b* engaged to and extending from the second end 12; a base stand 32 engaged to the second end 12; a first connector portion 13 configured proximate to the first end 11 of said main body 10; a second connector portion 14 configured proximate to the second end 12 of said main body 10; a first braking mechanism 15*a* located at said first connector portion 13; a second braking mechanism 15*b* located at said second connector portion 14; a tension controller terminating an end of said second connector portion 14; wherein said first connector portion 13 and said second connector portion 14 being spaced apart from each other along a common axis; said first connector portion 13 and said second connector portion 14 being adapted to engage two ends of an elongated core having stretch wrap film wrapped there around; said tension controller comprising an adjustable portion that is rotatable and in mechanical communication with a movable part located intermediate said tension controller and said second connector portion 14; and said adjustable portion is a rotatable knob 20, and said movable part is a clutching mechanism 23 connected to a shaft 24; characterized in that said tension controller further comprises a tension limiting mechanism.

To make sure the dispenser is on the right track in supplying the right tightening tension for this purpose, a tension limiter is needed. The only essential features for the device to works are a dispenser of stretch wrap, comprising a main body 10 having a first end 11 and a second end 12; a first connector portion 13 configured proximate to the first end 11 of said main body 10; a second connector portion 14 configured proximate to the second end 12 of said main body 10; a first braking mechanism 15*a* located at said first connector portion 13; a second braking mechanism 15*b* located at said second connector portion 14; a tension controller terminating an end of said second connector portion 14; wherein said first connector portion 13 and said second connector portion 14 being spaced apart from each other along a common axis; said first connector portion 13 and said second connector portion 14 being adapted to engage two ends of an elongated core having stretch wrap film wrapped there around; said tension controller comprising an adjustable portion that is rotatable and in mechanical communication with a movable part located intermediate said tension controller and said second connector portion 14; and said adjustable portion is a rotatable knob 20, and said movable part is a clutching mechanism 23 connected to a shaft 24; characterized in that said tension controller further comprises a tension limiting mechanism. These features are the only essential feature required to make the dispenser of stretch wrap work. Other features mentioned in this description are considered optional, with certain advantages, in terms of increasing efficiency of the device, unless the context clearly dictates otherwise.

Figure 2:
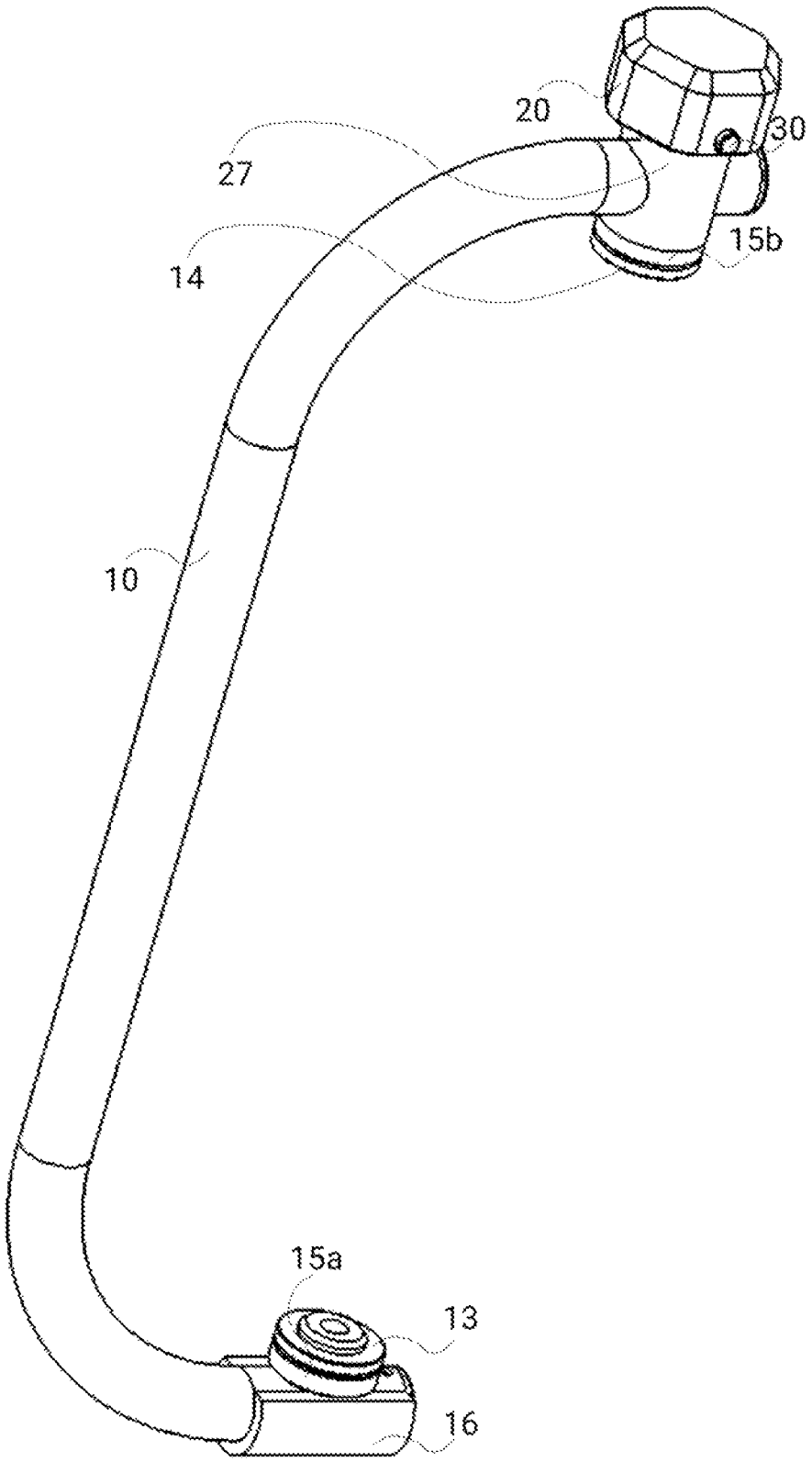
FIG. 2 shows a dispenser for a stretch wrap without the stretch wrap according to an embodiment of the present disclosure.
Figure 3:
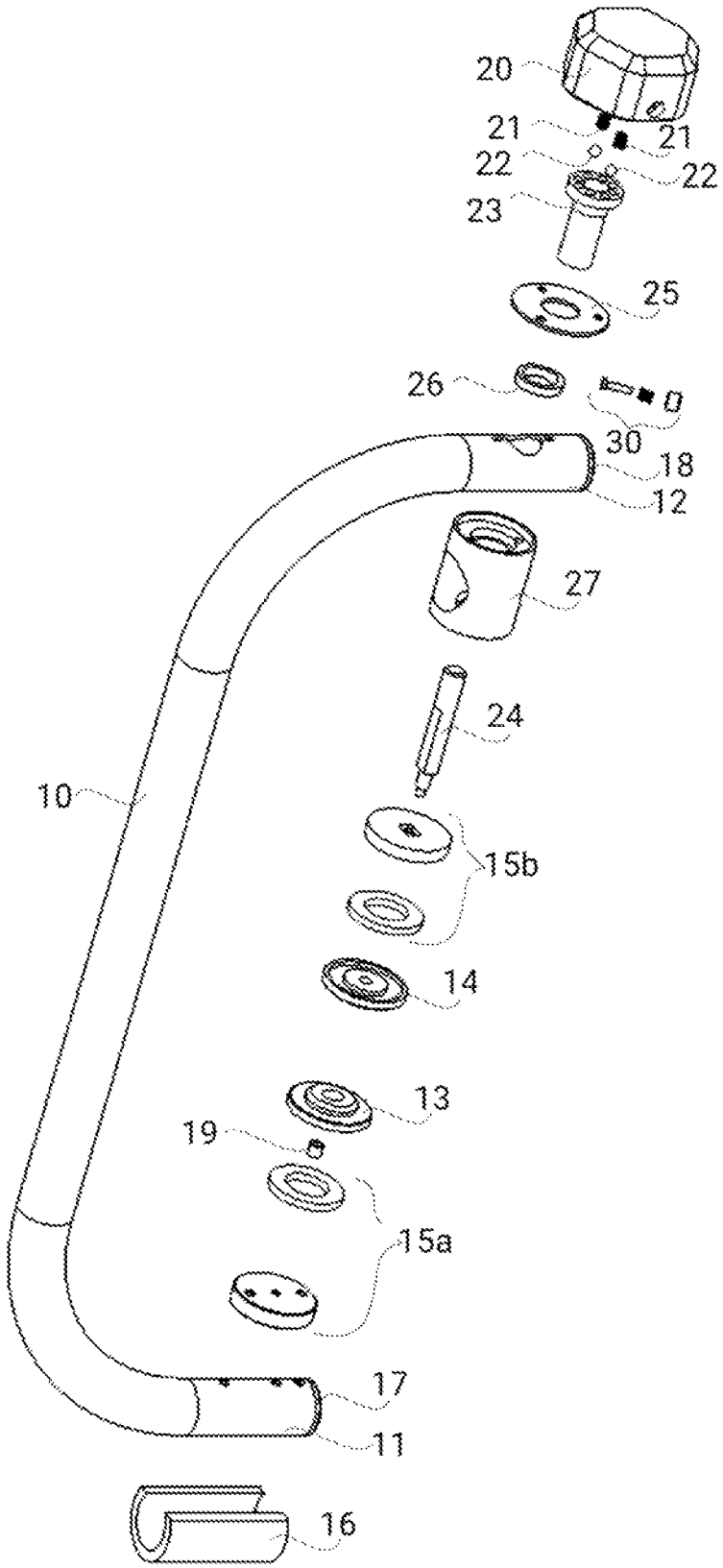
FIG. 3 shows an exploded view of a dispenser for a stretch wrap according to an embodiment of the present disclosure.

As shown cumulatively in FIGS. 1, 2 and 3, a dispenser of stretch wrap comprising a main body 10, a first connector portion 13, a second connector portion 14, a first braking mechanism 15*a*, a second braking mechanism 15*b*, a protective sleeve 16, a lower end cap 17, an upper end cap 18, a spacer 19, a knob 20, a clutching mechanism 23, a shaft 24, a knob cover 25, a rotation bearing 26, an upper main holder 27 and a gripping mechanism 30.

The main body 10 is a frame which holds all of the components of the dispenser of stretch wrap together. It has a first end 11 at its lower portion and a second end 12 at its upper portion. Preferably, the main body 10 is a C-shaped body as shown in FIGS. 1 to 3, however it may also be in any other shape as long as the first end 11 and the second end 12 are sharing the same axis. Preferably, with the help of the upper main holder 27 proximate the second end 12 of the main body 10, the main body 10 is able to hold together the whole upper components of the dispenser of stretch wrap, in the sense that the second end 12 of the main body 10 protruding through the upper main holder 27, and the connection between the shaft 24 and the clutching mechanism 23 is protruding through the upper main holder 27 and the second end 12 of the main body 10, in which the result can best be seen in FIGS. 1, 2 and 5. Preferably, a protective sleeve 16 is placed at the first end 11 of the main body 10 to protect the body from any dent and scratches especially if the operator is putting the dispenser of stretch wrap on the ground during the wrapping process. Preferably, the main body is made of strong material for example from metal such as but not limited to steel, stainless steel and galvanized steel. Preferably the main body 10 is a hollow body to reduce the weight of the dispenser of stretch wrap while at the same time able to maintain the strength of the frame. If the main body 10 is a hollow body, both the first end 11 and the second end 12 will be in the form of uncovered hollow pipe. Preferably, a lower end cap 17 is placed at the first end 11 and an upper end cap 18 is placed at the second end 12. This is to prevent any injury of the operator. Preferably, each of the lower end cap 17 and the upper end cap 18 comprises a magnetic bush connected to a covering portion. When inserted into the first end 11 and the second end 12, these end caps will be able to strengthen the structure of the main body 10. Preferably the main body 10 further comprising a rubberized portion (not shown) to allow the operator to use the dispenser in an easier manner.

Figure 5:
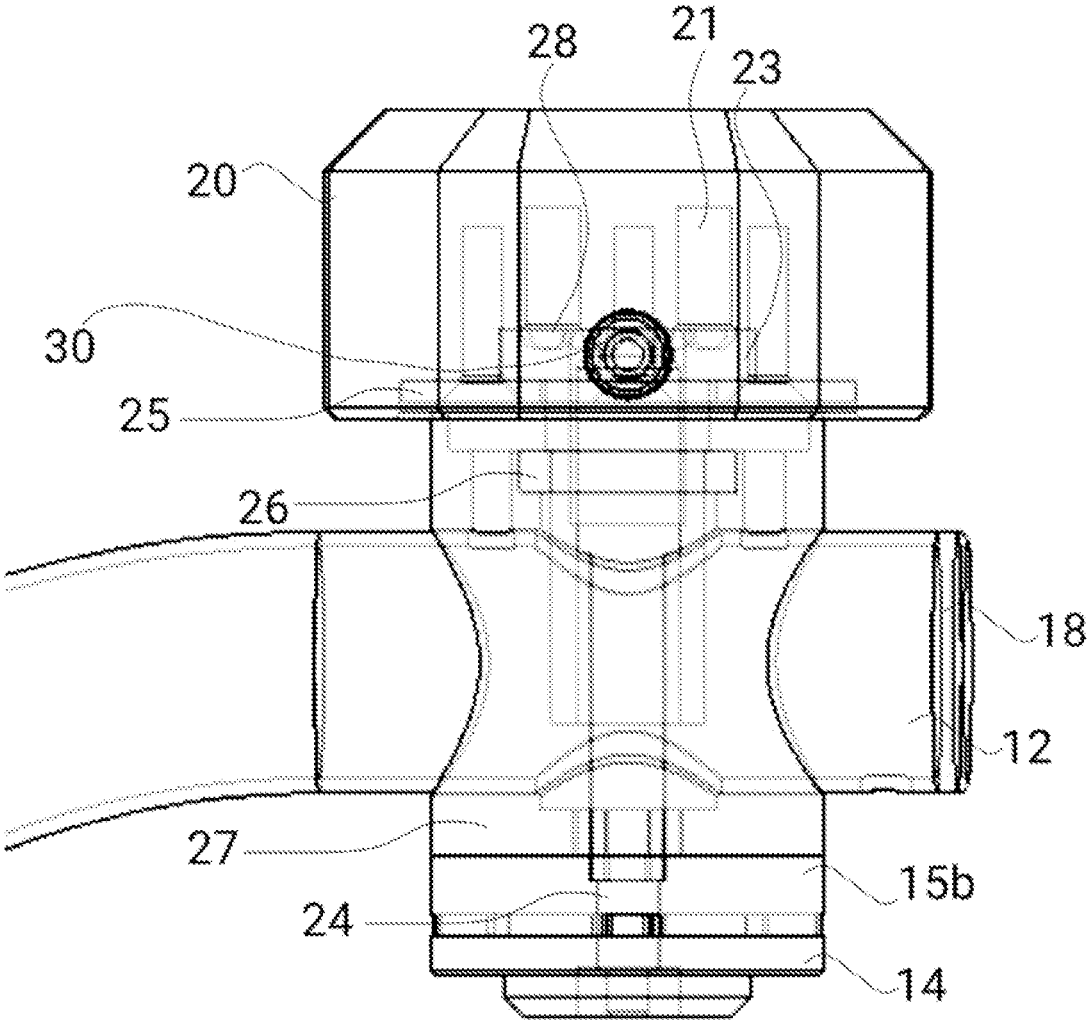
FIG. 5 shows the transparent view of the tension limiting mechanism with the knob according to an embodiment of the present disclosure.
Figure 6:
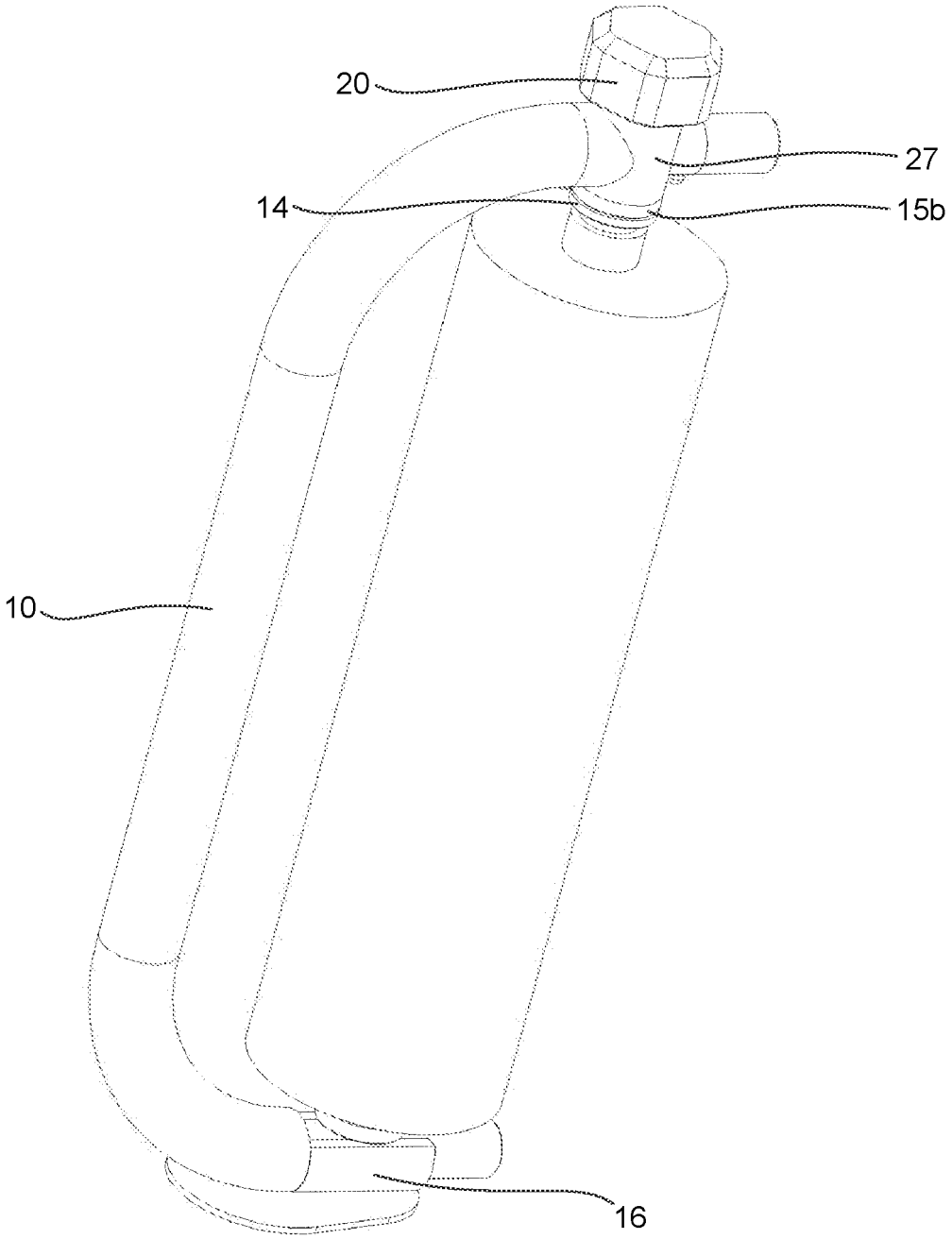
FIG. 6 shows a dispenser for a stretch wrap with the stretch wrap in position according to an embodiment of the present disclosure.
Figure 7:
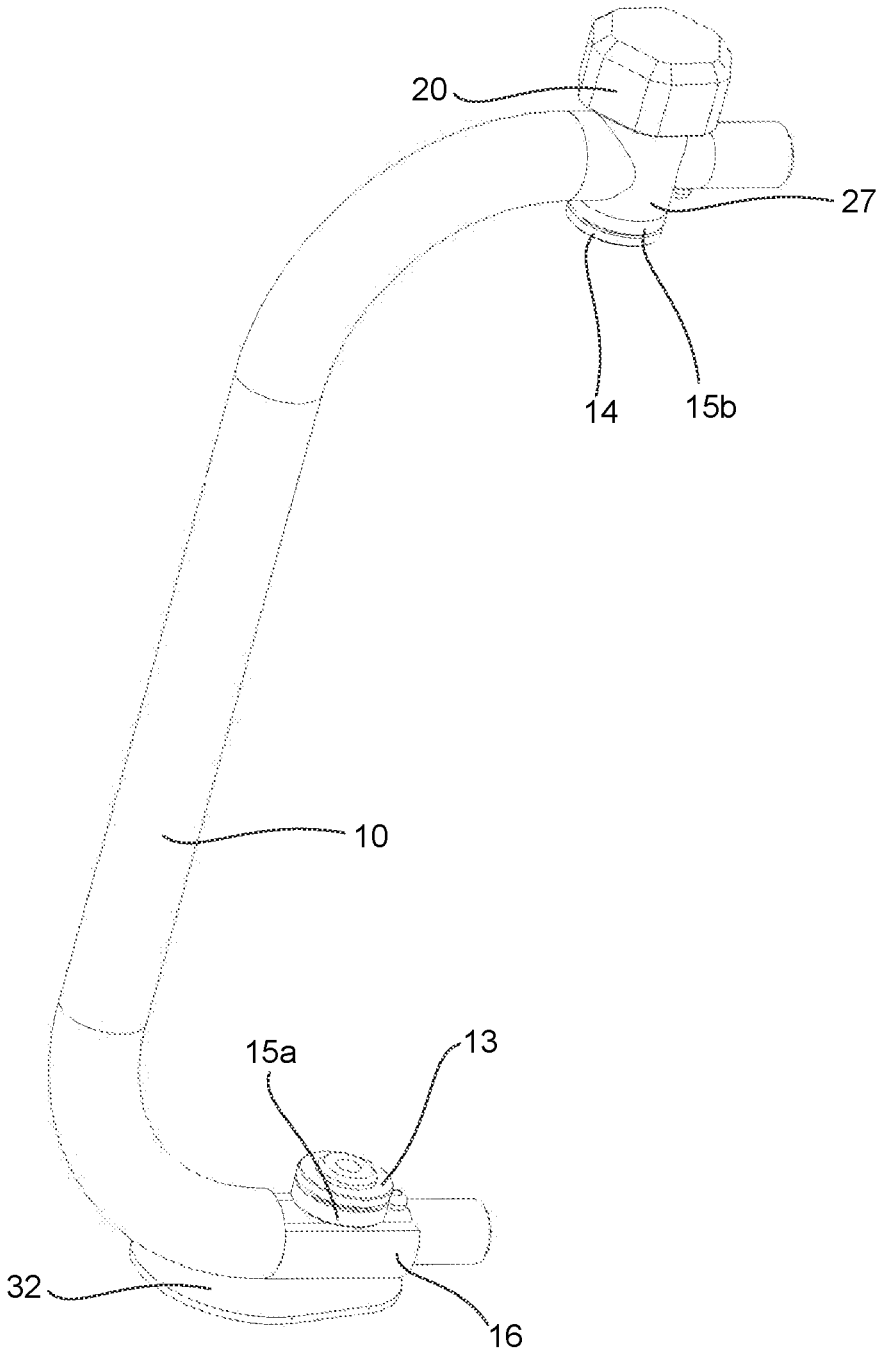
FIG. 7 shows a dispenser for a stretch wrap without the stretch wrap according to an embodiment of the present disclosure.
Figure 8:
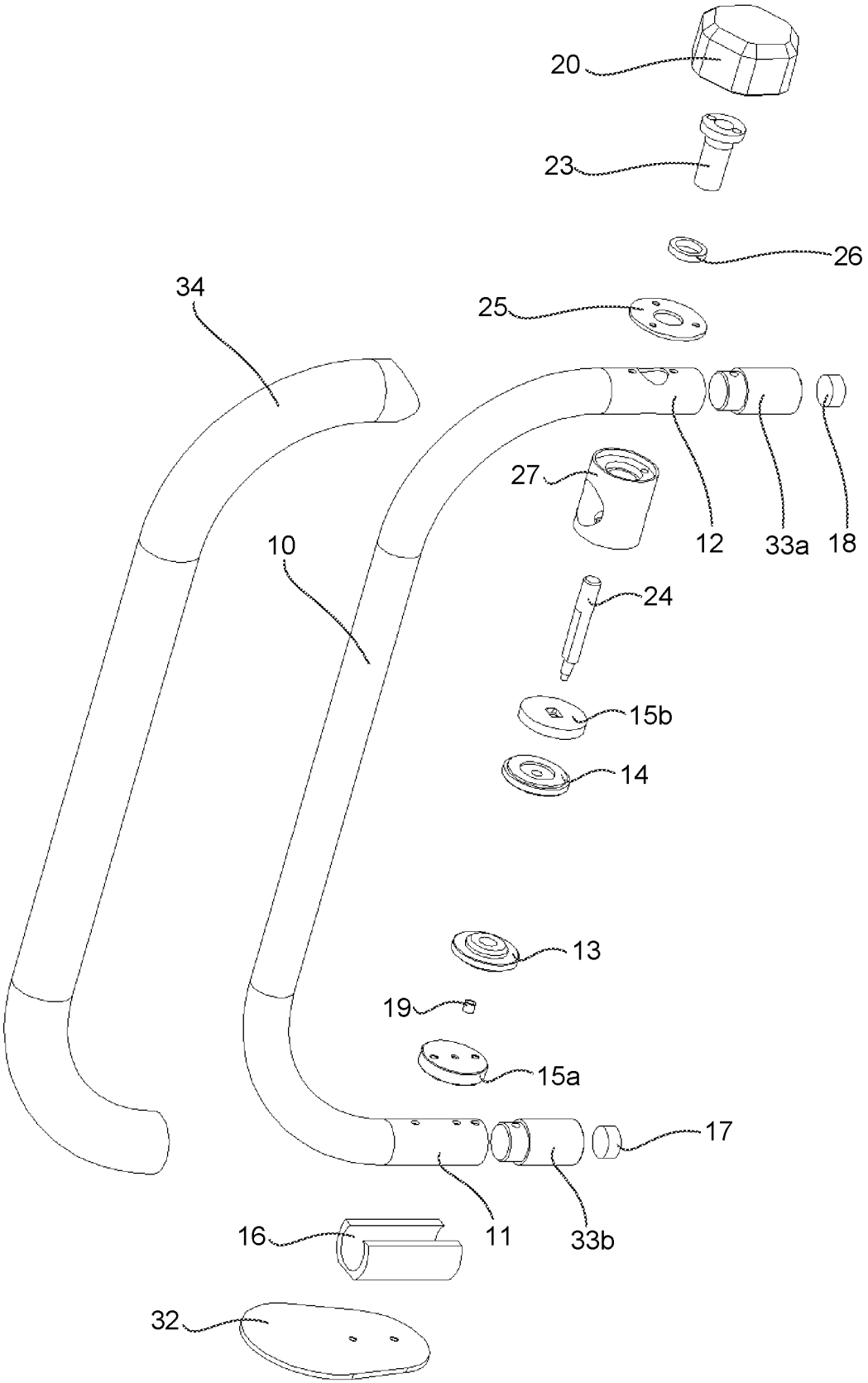
FIG. 8 shows an exploded view of a dispenser for a stretch wrap according to an embodiment of the present disclosure.

The first connector portion 13 and the second connector portion 14 are the holding portions, which will be directly in touch with the core of the stretch wrap during the operation as shown in FIG. 1. Both of them are configured to be able to undergo rotary movement together with the core of the stretch wrap to allow the stretch wrap film to be dispensed according to the need of the operator. The first connector portion 13 is configured proximate to the first end 11 of the main body 10 while the second connector portion 14 is configured proximate to the second end 12 of the main body 10. The first connector portion 13 and the second connector portion 14 being spaced apart from each other along a common axis, which in this case is a vertical axis. The first connector portion 13 and the second connector portion 14 being adapted to engage two ends of the elongated core of the stretch wrap. Preferably, surface finishing is applied to the parts of the first connector portion 13 and the second connector portion 14 which are adapted to engage the two ends of the elongated core of the stretch wrap. Preferably, the surface finishing is selected from horizontal milling, vertical milling and turning. Upon rigorous test, vertical milling is found the be the most effective surface finishing in gripping the two ends of the elongated core of the stretch wrap. Preferably, the arithmetic average roughness of the surface, Ra, is designed to be about 10 to about 15 um, more preferably about 12.5 um. Considering a regular core of the stretch wrap having a length of about 420±2 mm, preferably the first connector portion 13 and the second connector portion 14 being adapted to accommodate the engagement of the dispenser of the stretch wrap and the core of the stretch wrap. Preferably, the first connector portion 13 and the second connector portion 14 are made of aluminium. Preferably, for equipping the dispenser of the stretch wrap with the stretch wrap, only the second connector portion 14 is being penetrated towards the lower portion of the main body 10, which would define the tightening tension of the core of the stretch wrap. This penetration movement is being controlled by the tension controller. A first braking mechanism 15*a* and a second braking mechanism 15*b* are placed at the first connector portion 13 and the second connector portion 14 respectively. These braking mechanisms allow the first connector portion 13 and the second connector portion 14 to further grip on the two ends of the elongated core of the stretch wrap respectively and prevent any slipping. Preferably, each of the first braking mechanism 15*a* and the second braking mechanism 15*b* is a combination of a carbon steel plate and an oil-filled cast nylon ring pad. Preferably, the oil-filled cast nylon ring pad is sandwiched between the carbon steel plate and the first connector portion 13 and the second connector portion 14 respectively as best seen in FIG. 3. Typically, such oil-filled cast nylon ring pad is sold under the trade name of Nyloil™. Without the oil-filled cast nylon ring pad, the wear and tear of the first connector portion 13 and the second connector portion 14 is quite significant when operating alongside the carbon steel plate. By having the oil-filled cast nylon ring pad during the operation, the oil-filled cast nylon ring pad will be the first to go through the wear and tear process. When going through friction forces, the oil-filled cast nylon ring pad will slowly be turned into dust. However, having oil properties, the dust will stick to the carbon steel plate and the first connector portion 13 or the second connector portion 14 respectively, and continue protecting the carbon steel plate, the first connector portion 13 and the second connector portion 14 from wear and tear. This way, the durability of the first connector portion 13 and the second connector portion 14 will be increased significantly. Surprisingly, having these preferable settings on the first braking mechanism 15*a* and the second braking mechanism 15*b* gives a similar effect to the anti-lock braking system, which prevent the first braking mechanism 15*a* and the second braking mechanism 15*b* from completely locking up the rotation of the core of the stretch wrap. Surprisingly, this effect adds a significant plus point which contributes to avoiding accidental tearing of the stretch wrap. Preferably, the first connector portion 13 is connected proximate to the first end 11 of the main body 10 by using a spacer 19. Preferably, the spacer 19 is protruding through the first braking mechanism 15*a* to reach the first connector portion 13. As for the second connector portion 14, preferably the second connector portion 14 is in mechanical connection to the tension controller through the shaft 24, and the shaft 24 is protruding through the upper main holder 27, proximate to the second end 12 of the main body 10 and the second braking mechanism 15*b* to reach the second connector portion 14 as best seen in FIG. 5. Preferably, the second braking mechanism 15*b* has an aperture with the shape of the cross section of the shaft 24 to allow the shaft 24 to protrude through it. Preferably, the shape of the cross section of the shaft 24 is not circular. The shaft 24 is chosen from the shaft 24 that can be elongated and shortened by rotational movement, such as a bolt with a side flattened surface.

The tension controller is a part which could be used to control the tightening tension of the core of the stretch wrap. It is terminating an end of the second connector portion 14. The tension controller comprises an adjustable portion that is rotatable and in mechanical communication with the movable part located intermediate the tension controller and the second connector portion 14. The adjustable portion is a rotatable knob 20, and the movable part is a clutching mechanism 23 connected to a shaft 24. The tension controller further comprises a tension limiting mechanism. The knob 20 is rotatable, wherein in operation, manual rotation of the knob 20 decreases or increases friction on the second connector portion 14. Preferably, the knob is made of polymer material. This would allow the knob 20 to be molded from the polymer material to any shape and design that is required for the purpose of working this invention. Preferably, the tension limiting mechanism is located inside the knob 20. The tension limiting mechanism is a mechanism which limits the downward movement of the shaft 24 and the second connector portion 14 when the tightening tension to the core of the stretch wrap reaches a certain limit. It may exist in many forms, however two of the preferred embodiments are described here as an example, which is not intended to limit the invention. In the first preferred embodiment, the tension limiting mechanism exists in the form of a ball plunger (not shown). The ball plunger will be installed into the knob 20 with the ball facing towards the clutching mechanism. Preferably, the number of the ball plunger installed into the knob 20 is a multiplication of two and arranged to be in a symmetrical position, more preferably two. This is to ensure the knob 20 is stable during the rotation process. The clutching mechanism 23 is a coupling used to connect and disconnect a driving and a driven part. In this case, the driving part is the knob 20 and the ball plunger while the driven part is the shaft 24 and the second connector portion 14. Preferably, the clutching mechanism 23 is a plate having a plurality of concave portion(s) 28. Preferably, the plurality of concave portion 28 of the clutching mechanism 23 is arranged to be in circular shape. The lower part of the clutching mechanism 23 could be extended to connect to the shaft 24 as best seen in FIGS. 3 and 5, or the shaft 24 could be extended to connect to the clutching mechanism 23.

When the knob 20 is rotated, the ball plunger will also be rotated as it is located symmetrically inside the knob 20. The ball of the ball plunger will engage the concave portion 28 of the clutching mechanism 23 and drag the clutching mechanism 23 into rotational movement. This will in turn rotate the shaft 24 and elongate the shaft 24 with a bolt-like movement to push the second connector portion 14 towards the core of the stretch wrap. When the second connector portion 14 reaches the core of the stretch wrap, a tightening tension will start to arise because the core of the stretch wrap will start pushing back. The tightening tension will grow bigger as the second connector portion 14 going further downward compacting the core of the stretch wrap. When the right tightening tension is reached, the spring in the ball plunger will no longer be able to effectively push the ball of the ball plunger downward, resulting in the ball moving into the next empty concave portion 28 of the clutching mechanism 23. This will produce the sounds which would alert the operator that the right tightening tension is reached. The clutching mechanism 23 would no longer rotate even if the knob 20 is still being rotated, thus the shaft 24 could no longer push downward and the movement of the second connector portion 14 stops there. This way, the tightening tension limiting effect could be reached. In the second preferred embodiment, the tension limiting mechanism exists in the form of a metal ball 22 and a spring 21, which is placed inside a tunnel, the tunnel is formed inside the knob 20. The way it works is exactly the same as the first preferred embodiment works, so it won't be described twice. The rotation bearing 26 could make the rotation function of the clutching mechanism 23 smoother. The knob cover 25 will secure the vertical range movement of the clutching mechanism 23 inside the knob 20.

Figure 4:
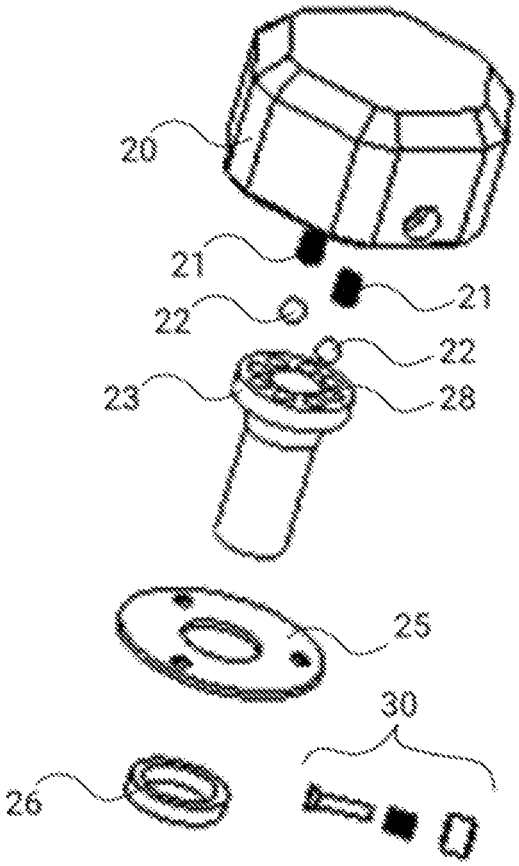
FIG. 4 shows an exploded view of the tension limiting mechanism with the knob according to an embodiment of the present disclosure.

The optional gripping mechanism 30 is a mechanism which can be used in two situations i.e. when the operator wants to further increase the tightening tension manually when it has already reached the limited preset tension of the dispenser of the stretch wrap; and when the clutching mechanism 23 is stuck. Preferably, the gripping mechanism 30 comprises a gripper part, a push button and a spring between the gripper part and the push button as best seen in FIG. 4. The gripping mechanism 30 is protruding through the knob 20 and adapted to grip the clutching mechanism 23 so that the clutching mechanism 23 will manually be forced to move according to the rotation of the knob 20 in certain situations. In the first situation as described above, the operator may push the gripping mechanism 30 while rotating it towards the tightening rotation, which would move the second connector portion 14 further downward while increasing the tightening tension. In the second situation as described above, the operator may push the gripping mechanism 30 while rotating it towards the loosening rotation for about one cycle and the stuck clutching mechanism 23 will typically start operating normally.

The preset tightening tension limit can be changed using a few ways such as but not limited to changing the spring of the tension limiting mechanism with a different stiffness or spring constant; change the depth of the tunnel formed inside the knob 20; changing the ball plunger with different load etc.

The optional magnets 33*a*, 33*b* are engaged to the first end 11 and second end 12 respectively. They allow the dispenser of stretch wrap to be temporarily or permanently stored while being magnetized to a metal surface. The optional handle cover 34 provides a softer, more comfortable material for a user to grasp and hold onto while the dispenser of stretch wrap is in use. The handle cover may also provide a more tacky surface to allow for easier retention of the dispenser of stretch wrap while in use. The optional base stand 32 is engaged to the second end 12 and allows the dispenser of stretch wrap to be placed on the floor or any other relatively horizontal surface when not in use. The magnets 33*a*, 33*b*, handle cover 34, and the base stand 32 allow users additional storage options for more convenient operation of the dispenser of stretch wrap.

1. A dispenser of stretch wrap, comprising:
   a main body (10) having a first end (11) and a second end (12);
   a first connector portion (13) configured proximate to the first end (11) of said main body (10);
   a second connector portion (14) configured proximate to the second end (12) of said main body (10);
   a first braking mechanism (15*a*) located at said first connector portion (13);
   a second braking mechanism (15*b*) located at said second connector portion (14);
   a tension controller terminating an end of said second connector portion (14);
   wherein said first connector portion (13) and said second connector portion (14) being spaced apart from each other along a common axis;
   said first connector portion (13) and said second connector portion (14) being adapted to engage two ends of an elongated core having stretch wrap film wrapped there around;
   said tension controller comprising an adjustable portion that is rotatable and in mechanical communication with a movable part located intermediate said tension controller and said second connector portion (14); and
   said adjustable portion is a rotatable knob (20), and said movable part is a clutching mechanism (23) connected to a shaft (24);
   characterized in that:
   said tension controller further comprises a tension limiting mechanism.

2. The dispenser of stretch wrap as claimed in claim 1, wherein said tension limiting mechanism is a ball plunger.

3. The dispenser of stretch wrap as claimed in claim 1, wherein said tension limiting mechanism is a combination of a metal ball (22) and a spring (21), which is placed inside a tunnel, said tunnel is formed inside said tension controller.

4. The dispenser of stretch wrap as claimed in claim 1, wherein said clutching mechanism (23) is a plate having a plurality of concave portion (28).

5. The dispenser of stretch wrap as claimed in claim 1, wherein each of said first braking mechanism (15*a*) and said second braking mechanism (15*b*) is a combination of a carbon steel plate and an oil-filled cast nylon ring pad.

6. The dispenser of stretch wrap as claimed in claim 1, wherein each of said first connector portion (13) and said second connector portion (14) is made of aluminium.

7 The dispenser of stretch wrap as claimed in claim 1, wherein said dispenser further comprising a gripping mechanism (30) which is protruding through said tension controller and adapted to grip said clutching mechanism (23).

8. The dispenser of stretch wrap as claimed in claim 1, wherein said dispenser further comprising a protective sleeve (16) at the first end (11) of said main body (10).

9. The dispenser of stretch wrap as claimed in claim 1, wherein said main body (10) is a C-shaped body.

10. The dispenser of stretch wrap as claimed in claim 1, wherein said main body (10) is a hollow body.

11. A dispenser of stretch wrap, comprising:
   a main body (10) having a first end (11) and a second end (12);
   a first magnet (33*a*) engaged to and extending from the first end (11);
   a second magnet (33*b*) engaged to and extending from the second end (12);
   a base stand (32) engaged to the second end (12);
   a first connector portion (13) configured proximate to the first end (11) of said main body (10);
   a second connector portion (14) configured proximate to the second end (12) of said main body (10);
   a first braking mechanism (15*a*) located at said first connector portion (13);
   a second braking mechanism (15*b*) located at said second connector portion (14);
   a tension controller terminating an end of said second connector portion (14);
   wherein said first connector portion (13) and said second connector portion (14) being spaced apart from each other along a common axis;
   said first connector portion (13) and said second connector portion (14) being adapted to engage two ends of an elongated core having stretch wrap film wrapped there around;
   said tension controller comprising an adjustable portion that is rotatable and in mechanical communication with a movable part located intermediate said tension controller and said second connector portion (14); and
   said adjustable portion is a rotatable knob (20), and said movable part is a clutching mechanism (23) connected to a shaft (24);
   characterized in that:
   said tension controller further comprises a tension limiting mechanism.

12. The dispenser of stretch wrap as claimed in claim 11, wherein said tension limiting mechanism is a ball plunger.

13. The dispenser of stretch wrap as claimed in claim 11, wherein said tension limiting mechanism is a combination of a metal ball (22) and a spring (21), which is placed inside a tunnel, said tunnel is formed inside said tension controller.

14. The dispenser of stretch wrap as claimed in claim 11, wherein said clutching mechanism (23) is a plate having a plurality of concave portion (28).

15. The dispenser of stretch wrap as claimed in claim 11, wherein each of said first braking mechanism (15*a*) and said second braking mechanism (15*b*) is a combination of a carbon steel plate and an oil-filled cast nylon ring pad.

16. The dispenser of stretch wrap as claimed in claim 11, wherein each of said first connector portion (13) and said second connector portion (14) is made of aluminium.

17. The dispenser of stretch wrap as claimed in claim 11, wherein said dispenser further comprising a gripping mechanism (30) which is protruding through said tension controller and adapted to grip said clutching mechanism (23).

18. The dispenser of stretch wrap as claimed in claim 11, wherein said dispenser further comprising a protective sleeve (16) at the first end (11) of said main body (10).

19. The dispenser of stretch wrap as claimed in claim 11, wherein said main body (10) is a C-shaped body.

20. The dispenser of stretch wrap as claimed in claim 11, wherein said main body (10) is a hollow body.

Any method described herein may incorporate any design element contained within this application and any other document/application incorporated by reference herein.

To the accomplishment of the foregoing and related ends, one or more various embodiments include the features hereinafter fully described and particularly pointed out in the claims. The following description and the annexed drawings set forth in detail certain illustrative aspects and are indicative of but a few of the various ways in which the principles of the various embodiments may be employed. Other advantages and novel features will become apparent from the following detailed description when considered in conjunction with the drawings and the disclosed various embodiments are intended to include all such aspects and their equivalents.

Other aspects, advantages, and salient features of the disclosure will become apparent to those skilled in the art from the following detailed description, which, taken in conjunction with the annexed drawings, discloses various embodiments of the present disclosure.

While the present disclosure has been shown, and described with reference to various embodiments thereof, it will be understood by those ordinary skilled in the art that various changes in form and details may be made therein without departing from the scope of the present disclosure as defined by the appended claims and their equivalents.

The invention claimed is:

1. A dispenser of stretch wrap, comprising:

a main body (10) having a first end (11) and a second end (12);

a first connector portion (13) configured proximate to the first end (11) of said main body (10);

a second connector portion (14) configured proximate to the second end (12) of said main body (10);

a first braking mechanism (15*a*) located at said first connector portion (13);

a second braking mechanism (15*b*) located at said second connector portion (14);

wherein each of said first braking mechanism (15*a*) and said second braking mechanism (15*b*) is a combination of a carbon steel plate and an oil-filled cast nylon ring pad;

a tension controller terminating an end of said second connector portion (14);

wherein said first connector portion (13) and said second connector portion (14) being spaced apart from each other along a common axis;

said first connector portion (13) and said second connector portion (14) being adapted to engage two ends of an elongated core having stretch wrap film wrapped there around;

said tension controller comprising an adjustable portion that is rotatable and in mechanical communication with a movable part located intermediate said tension controller and said second connector portion (14); and said adjustable portion is a rotatable knob (20), and said movable part is a clutching mechanism (23) connected to a shaft (24);

characterized in that:

said tension controller further comprises a tension limiting mechanism; and a gripping mechanism (30) which is protruding through said tension controller and adapted to grip said clutching mechanism (23).

2. The dispenser of stretch wrap as claimed in claim 1, wherein said tension limiting mechanism is a ball plunger.

3. The dispenser of stretch wrap as claimed in claim 1, wherein said tension limiting mechanism is a combination of a metal ball (22) and a spring (21), which is placed inside a tunnel, said tunnel is formed inside said tension controller.

4. The dispenser of stretch wrap as claimed in claim 1, wherein said clutching mechanism (23) is a plate having a plurality of concave portion (28).

5. The dispenser of stretch wrap as claimed in claim 1, wherein each of said first connector portion (13) and said second connector portion (14) is made of aluminum.

6. The dispenser of stretch wrap as claimed in claim 1, wherein said dispenser further comprising a protective sleeve (16) at the first end (11) of said main body (10).

7. The dispenser of stretch wrap as claimed in claim 1, wherein said main body (10) is a C-shaped body.

8. The dispenser of stretch wrap as claimed in claim 1, wherein said main body (10) is a hollow body.

9. A dispenser of stretch wrap, comprising:

a main body (10) having a first end (11) and a second end (12);

a first magnet (33*a*) engaged to and extending from the first end (11);

a second magnet (33*b*) engaged to and extending from the second end (12);

a base stand (32) engaged to the second end (12);

a first connector portion (13) configured proximate to the first end (11) of said main body (10);

a second connector portion (14) configured proximate to the second end (12) of said main body (10);

a first braking mechanism (15*a*) located at said first connector portion (13);

a second braking mechanism (15*b*) located at said second connector portion (14);

wherein each of said first braking mechanism (15*a*) and said second braking mechanism (15*b*) is a combination of a carbon steel plate and an oil-filled cast nylon ring pad;

a tension controller terminating an end of said second connector portion (14);

wherein said first connector portion (13) and said second connector portion (14) being spaced apart from each other along a common axis;

said first connector portion (13) and said second connector portion (14) being adapted to engage two ends of an elongated core having stretch wrap film wrapped there around;

said tension controller comprising an adjustable portion that is rotatable and in mechanical communication with a movable part located intermediate said tension controller and said second connector portion (14); and said adjustable portion is a rotatable knob (20), and said movable part is a clutching mechanism (23) connected to a shaft (24);

characterized in that:

said tension controller further comprises a tension limiting mechanism.

10. The dispenser of stretch wrap as claimed in claim 9, wherein said tension limiting mechanism is a ball plunger.

11. The dispenser of stretch wrap as claimed in claim 9, wherein said tension limiting mechanism is a combination of a metal ball (22) and a spring (21), which is placed inside a tunnel, said tunnel is formed inside said tension controller.

12. The dispenser of stretch wrap as claimed in claim 9, wherein each of said first connector portion (13) and said second connector portion (14) is made of aluminium.

13. The dispenser of stretch wrap as claimed in claim 9, wherein said dispenser further comprising a gripping mechanism (30) which is protruding through said tension controller and adapted to grip said clutching mechanism (23).

14. The dispenser of stretch wrap as claimed in claim 9, wherein said dispenser further comprising a protective sleeve (16) at the first end (11) of said main body (10).

15. The dispenser of stretch wrap as claimed in claim 9, wherein said main body (10) is a C-shaped body.

16. The dispenser of stretch wrap as claimed in claim 9, wherein said main body (10) is a hollow body.

* * * * *